US008905326B2

(12) United States Patent
Greenwood et al.

(10) Patent No.: US 8,905,326 B2
(45) Date of Patent: Dec. 9, 2014

(54) HIGH-VOLUME, PART-CIRCLE SPRINKLER HEAD

(75) Inventors: Riley Greenwood, Walla Walla, WA (US); Craig Nelson, Walla Walla, WA (US); Chad Leinweber, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 509 days.

(21) Appl. No.: 13/345,316

(22) Filed: Jan. 6, 2012

(65) Prior Publication Data

US 2013/0175360 A1 Jul. 11, 2013

(51) Int. Cl.
*B05B 3/04* (2006.01)

(52) U.S. Cl.
USPC ..... 239/263; 239/225.1

(58) Field of Classification Search
CPC ..... B05B 13/04; B05B 13/0405
USPC ..... 239/263, 225.1, 233, 237, 240, 242, 239/255
See application file for complete search history.

(56) References Cited

U.S. PATENT DOCUMENTS

| | | | | |
|---|---|---|---|---|
| 2,649,268 | A | 8/1953 | Stein | |
| 3,507,336 | A | 4/1970 | Nelson | |
| 3,559,887 | A | 2/1971 | Meyer | |
| 3,580,507 | A | 5/1971 | Beamer | |
| 3,592,388 | A | 7/1971 | Friedlander | |
| 3,623,666 | A | 11/1971 | Meyer | |
| 3,744,720 | A | 7/1973 | Meyer | |
| 3,986,671 | A | 10/1976 | Nugent | |
| 4,094,467 | A | 6/1978 | Meyer | |
| 4,109,866 | A | 8/1978 | Brandl | |
| 4,153,202 | A | 5/1979 | Meyer | |
| 4,161,286 | A | 7/1979 | Beamer et al. | |
| 4,193,548 | A | 3/1980 | Meyer | |
| 4,342,424 | A | 8/1982 | Meyer et al. | |
| 4,353,506 | A * | 10/1982 | Hayes | 239/206 |
| 5,353,989 | A | 10/1994 | Drechsel | |
| 5,597,119 | A * | 1/1997 | Gorney et al. | 239/241 |
| 6,607,147 | B2 | 8/2003 | Schneider et al. | |
| 6,840,460 | B2 * | 1/2005 | Clark | 239/205 |
| 7,631,813 | B1 * | 12/2009 | Lichte et al. | 239/11 |

OTHER PUBLICATIONS

PCT International Search Report dated Mar. 1, 2013 issued in PCT International Patent Application No. PCT/US2013/020500, 1 page.

* cited by examiner

*Primary Examiner* — Davis Hwu
(74) *Attorney, Agent, or Firm* — Nixon & Vanderhye P.C.

(57) ABSTRACT

A high-volume sprinkler head includes a barrel with a nozzle; a fixed portion and a relatively movable portion adapted for pivoting movement relative to the fixed portion. The barrel is mounted on an upper support base rotatable on a lower stationary base in opposite directions through an arc about a vertical axis. A fluid-operated actuator pivots the relatively movable portion of the barrel relative to the fixed portion of the barrel between first and second reaction angles that cause the barrel and the annular upper support base to rotate in opposite directions, about the substantially vertical axis, respectively, when a stream is emitted from the nozzle. A three-way valve in combination with adjustable stops on the stationary base may be used to pilot the actuator, with the adjustable stops determining the arcuate extent of the rotational movement of the sprinkler head.

20 Claims, 14 Drawing Sheets

HIGH-VOLUME, PART-CIRCLE SPRINKLER HEAD

BACKGROUND AND SUMMARY

This invention relates to sprinklers and particularly high-volume, part-circle sprinklers used in agricultural irrigation.

Sprinkler heads of the high-capacity type of interest in this application are disclosed, for example, in the following U.S. Pat. Nos. 2,649,268; 3,559,887; 3,580,507; 3,592,388; 3,623,666; 3,744,720; and 3,986,671. It is characteristic of all these sprinkler heads that they include a stationary annular housing which is in fluid communication with a source of water under pressure, with a rotating sprinkler body assembly mounted on the stationary housing assembly for rotation about a generally vertically extending axis. Typically, the sprinkler head includes a barrel that is movable back-and-forth by means of a fairly complex mechanical arrangement, within a defined arc set by adjustable stops. Some sprinkler heads of this type also incorporate a pulse arm that moves into and out of the stream emitted by the nozzle. The pulse arm is generally driven in one direction by the emitted stream and in the appropriate direction by a spring or the like. Interruption of the stream tends to even out the sprinkler pattern.

There remains a need for a high-volume sprinkler having a simple, reliable and cost-effective mechanism for enabling automatic reversal of the direction of rotation of the sprinkler head through easily adjustable, part-circle arcs of rotation.

In one exemplary but nonlimiting embodiment, there is disclosed and described herein a high-volume sprinkler head comprising a barrel having a nozzle at one end thereof, the barrel having a fixed portion and a relatively movable portion adapted for pivoting movement relative to the fixed portion. The barrel is mounted on an annular upper support base rotatably supported on a lower stationary base for rotation in opposite directions through an arc, about a substantially vertical axis. A fluid-operated actuator is arranged to pivot the relatively movable portion of the barrel relative to the fixed portion of the barrel between predetermined first and second reaction angles that cause the barrel and the annular upper support base to rotate in opposite directions, about the substantially vertical axis, respectively, when a stream is emitted from the nozzle. First and second magnets (or "stops") are supported at circumferentially-spaced locations about an edge of the lower stationary base, the pair of magnets having reverse polarities. A magnetic valve is mounted on the upper support base in fluid communication with the actuator, and the magnetic valve is adapted to align with the first magnet upon rotation of the barrel and the annular upper support base in one of the two opposite directions, and to align with the second magnet upon rotation of the barrel and the annular upper support base the other of the opposite directions. The magnetic valve, under influence of the first and second magnets, is operative, respectively, to supply fluid under pressure to the fluid-operated actuator to cause the relatively movable portion of the barrel to pivot to the first predetermined reaction angle, and to drain fluid from the fluid-operated actuator to cause the relatively movable portion of the barrel to pivot to the second predetermined reaction angle.

It is another feature of the exemplary embodiment that the first and second magnets are adjustable along the edge of the lower stationary base to thereby enable adjustment of the arc.

It is another feature of the exemplary embodiment that the fluid-operated actuator incorporates a spring that causes the cylinder to retract to thereby move the relatively movable portion of the barrel to said second predetermined reaction angle.

When fluid is drained from the fluid-operated actuator, a spring causes the cylinder to retract to thereby move the relatively movable portion of the barrel to the second predetermined reaction angle.

It is another feature that the fixed portion and the relatively movable portion of the barrel are connected by a ball joint, an upper component of the ball joint provided on the relatively movable portion of the barrel and a lower component of the ball joint provided on the relatively fixed portion of the barrel. A pair of oppositely extending pivot pins are provided on the upper component of the ball joint, the pivot pins received in respective brackets secured to the fixed portion of the barrel.

It is another feature that adjustment screws are arranged to engage the upper component of the ball joint to enable adjustment of the pivoting movement of the fixed portion of the barrel relative to the relatively movable portion of the barrel, thereby enabling adjustment of the first and second reaction angles.

It is another feature that the sprinkler head is provided with a stream interrupter rod having a distal end movable into and out of the stream emitted from said nozzle.

It is another feature of an alternative embodiment that the magnetic valve and magnets be omitted in favor of a three-way mechanical toggle valve in combination with mechanical stops.

Still other features, advantages and benefits of the exemplary embodiment will become apparent from the detailed description that follows in connection with the drawings identified below.

DETAILED DESCRIPTION

Figure 1:
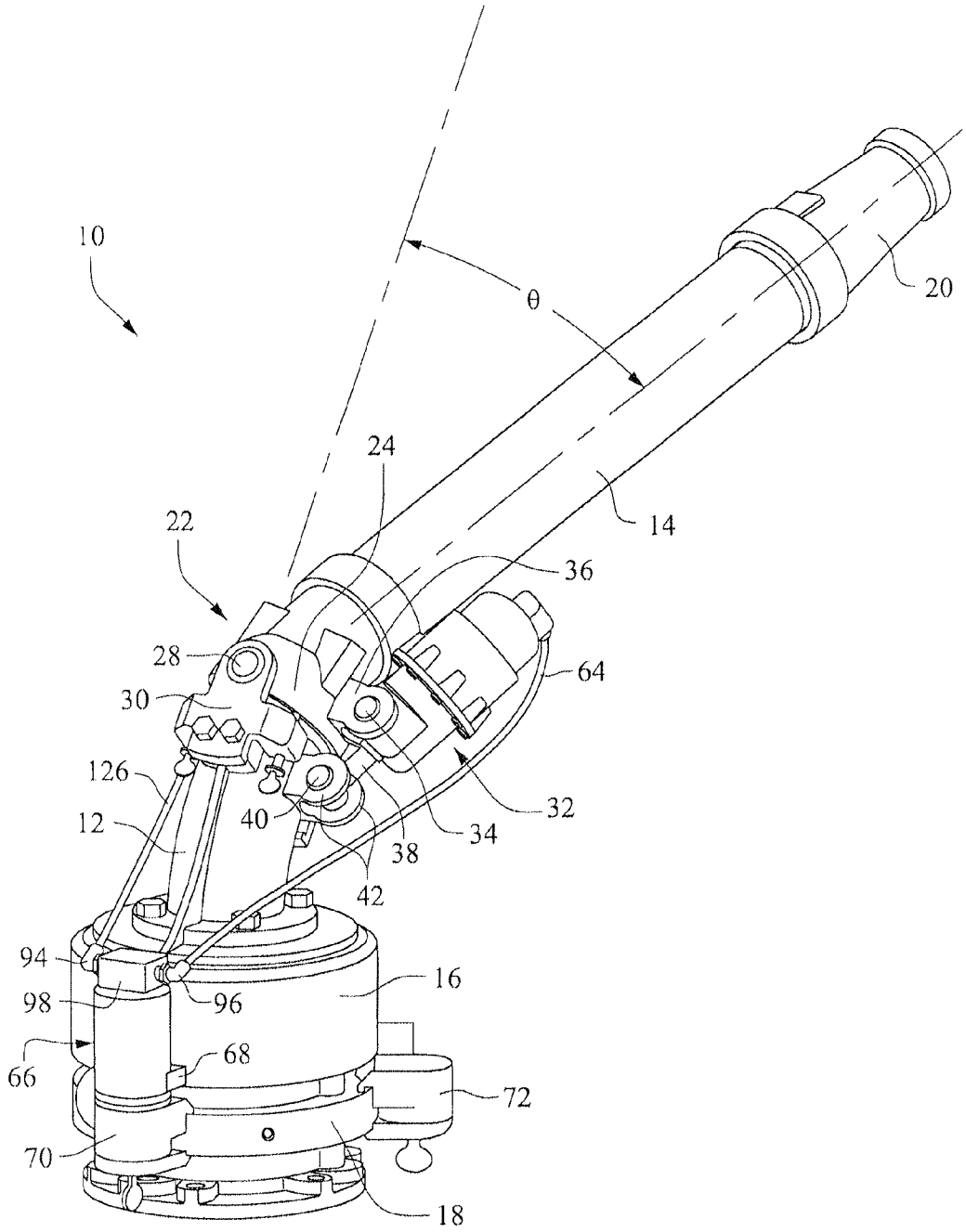
FIG. 1 is a perspective view of a high-volume sprinkler head in accordance with an exemplary but nonlimiting embodiment of the invention, showing a movable portion of the sprinkler head barrel pivoted to a first-reaction angle.
Figure 2:
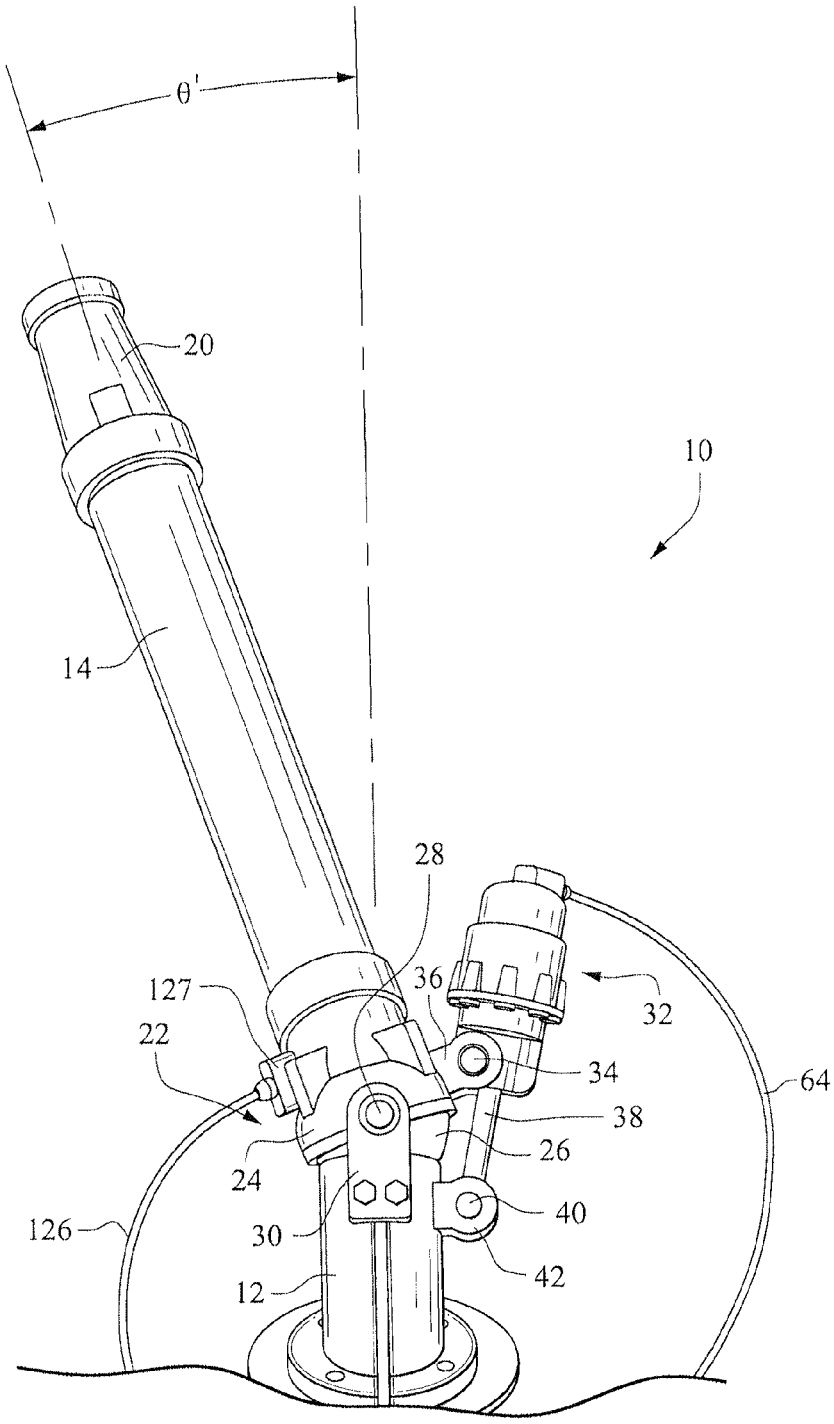
FIG. 2 is a perspective view of the high-volume sprinkler head shown in FIG. 1, but with the movable barrel portion pivoted to a second-reaction angle.

In accordance with an exemplary but nonlimiting embodiment, and with reference initially to FIGS. 1 and 2, a high-volume sprinkler head 10 includes a fixed barrel portion 12 and a movable barrel portion 14, both secured to a rotatable upper base 16 that is supported on a stationary lower base 18. In other words, the barrel portion 14 is movable relative to the barrel portion 12, and both rotate with the base 16. The movable barrel portion 14 is provided with a suitable nozzle 20 through which a high-pressure stream of water (or other liquid) is emitted.

Figure 3:
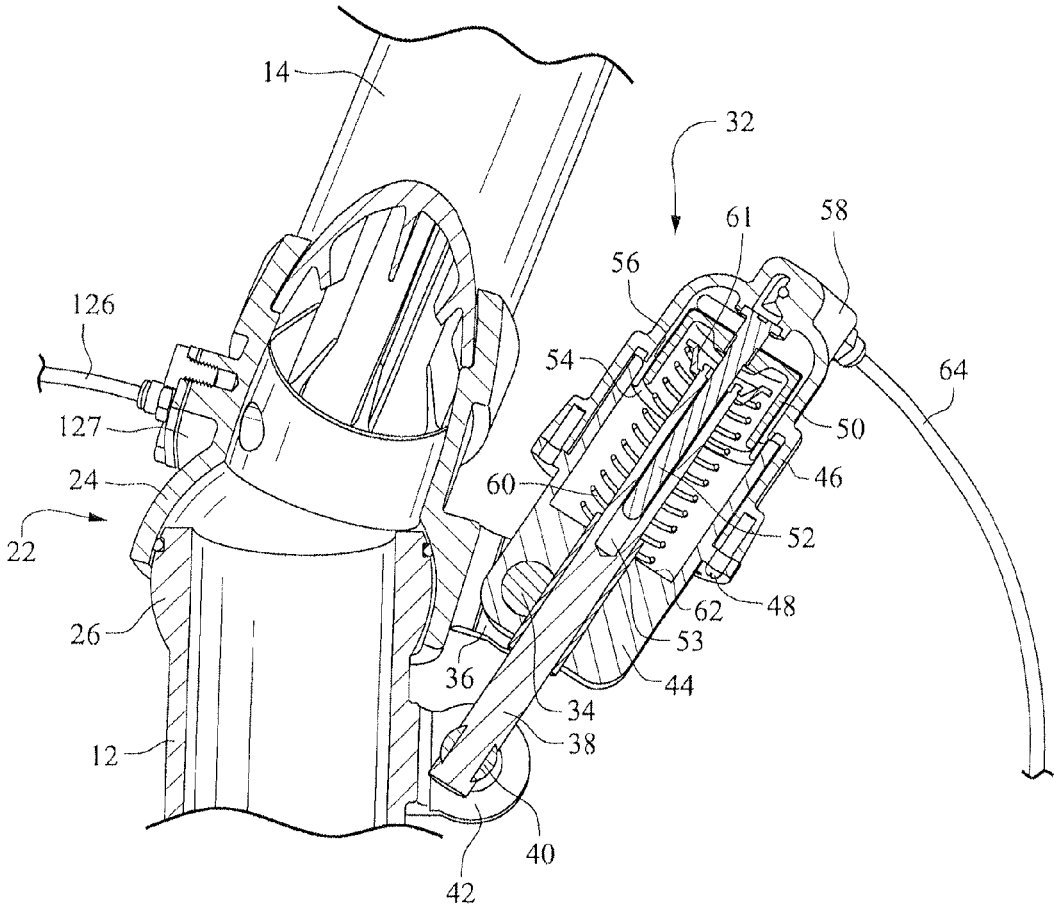
FIG. 3 is a partial perspective view, partially sectioned, illustrating an actuator for pivoting the movable barrel portion between reaction angles.

The movable barrel portion 14 is attached to the fixed barrel portion 12 by means of a ball joint 22, best seen in FIGS. 2 and 3. Specifically, an outer, inverted cup-shaped portion 24 on the movable barrel portion 14 slides over and about a complimentary inner, upright cup portion 26 on the fixed barrel portion 12, noting that movement of the barrel portion 14 is confined to pivoting motion about ears or pins 28 on the outer cup-shaped portion 24 which are received in brackets 30 attached to the fixed barrel portion 12. Thus, the movable barrel portion 14 may be pivoted in opposite directions, between angle Ø and angle Ø' (also referred to herein as the "reaction drive angles" or, simply, "reaction angles") as shown in FIGS. 1 and 2, respectively. The angular offset (at angle Ø) of the movable barrel portion 14 causes rotation of both barrel portions 12 and 14 and the upper base 16 in one direction, about a vertical axis extending through the upper and lower base components 16, 18, when the high pressure stream is emitted from the nozzle 20. When the barrel is offset at the opposite reaction angle Ø', rotation of the sprinkler is in the opposite direction. Thus, it will be appreciated that both barrel portions 12 and 14 are rotatable together with the upper base 16 between limits defined by the reaction angles. The reaction angles thus define the arcuate path of travel of the barrel portion 12 relative to barrel portion 14 and the upper base 16. The invention here relates primarily to the manner in which the barrel portion 14 is moved relative to barrel portion 12 automatically and continuously, back and forth, between the reaction angles Ø and Ø' during operation of the sprinkler head.

With continued reference to FIGS. 1-3, a hydraulic actuator (or cylinder) 32 is secured at one end to the movable barrel portion 14 by means of pins 34 extending from opposite sides of the cylinder and received in tabs or pivot lugs 36 extending from the movable barrel portion 14. A distal end of a piston rod 38 of the hydraulic actuator or cylinder 32 is similarly attached to the fixed barrel portion 12, via pins 40 received in tabs or pivot lugs 42. It will be appreciated that when the piston rod 38 is retracted (i.e., received within the cylinder) to the position shown in FIG. 1, the barrel will be pulled to the right to reaction drive angle Ø. Upon pressurization of the hydraulic actuator, as described in further detail herein, the cylinder 32 is pushed upwardly (as viewed in FIGS. 1 and 2) relative to the fixed piston rod 38 thereby causing the movable barrel portion 14 to pivot about the pins 28, to the reaction drive angle Ø' as shown in FIG. 2.

With reference especially to FIG. 3, the actuator 32 includes a pair of tubular housing members 44, 46, joined by fasteners, e.g., screws 48 (one shown). A cup-shaped piston 50 is fixed to one end of the piston rod 38, the latter arranged for sliding motion along a fixed center bolt 52 within the actuator, received in a center bore 53 formed in the piston rod 38. An annular, rolling diaphragm 54 is attached radially between the piston 50 and the juncture between the housing members 44, 46, thereby creating a sealed pressure chamber 56 above and about the piston 50, in communication with a fluid inlet 58. A coil spring 60 extends between a land 62 in the lower housing member 44 and a convex disc 61 secured to the piston rod 38, biasing the piston rod 38 upwardly toward the inlet 58.

When fluid is supplied to the chamber 56 via line 64, the cylinder housing portions 44, 46 will pivot in a counterclockwise direction about the pins 34 and axially along the fixed piston rod 38 relative to the piston rod 38, causing the movable barrel portion 14 to swing in a counterclockwise direction from the reaction angle Ø to the reaction angle Ø', against the bias of the coil spring 60.

When fluid is drained from the cylinder 32 via line 64, the coil spring 60 will cause the housing to pivot in a clockwise direction and thus push the cylinder housing portions 44, 46 axially downwardly along the piston rod 38 to the position shown in FIG. 1, i.e., to the reaction angle Ø.

Figure 4:
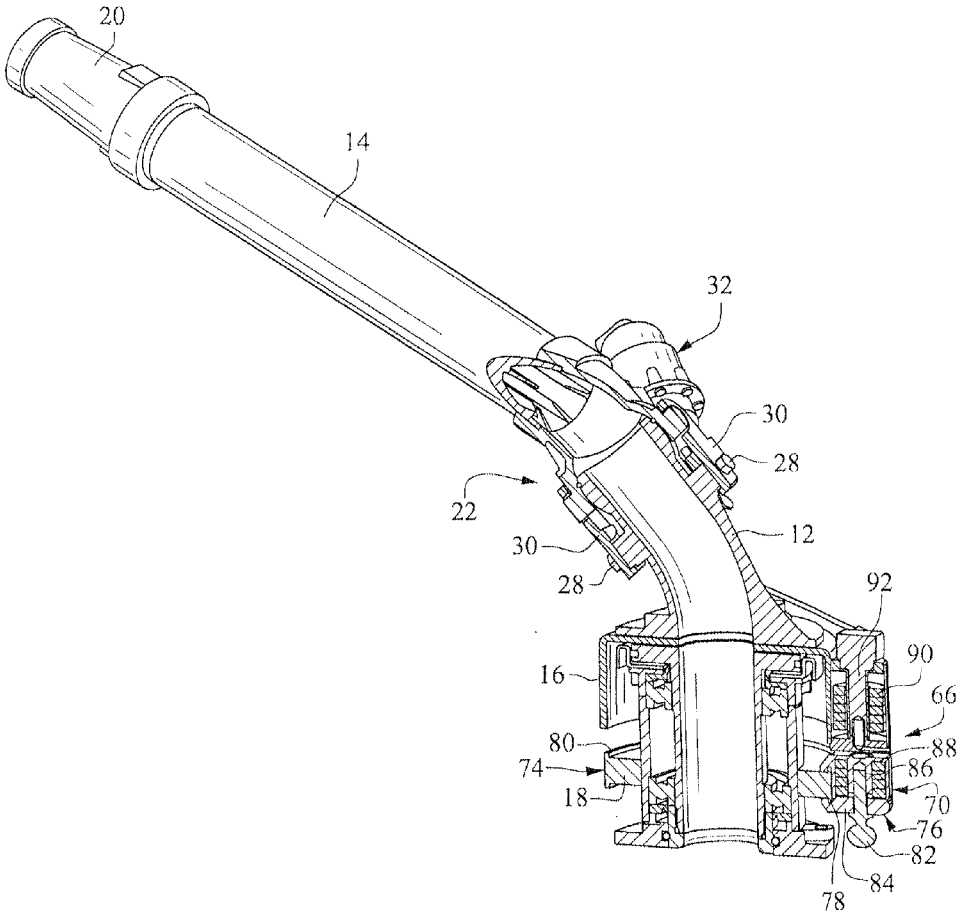
FIG. 4 is a perspective view of the high-volume sprinkler head shown in FIGS. 1 and 2 with the base shown in section, and illustrating a magnetic-latching valve that controls the actuator shown in FIG. 3 through interaction with magnets fixed to a stationary base.

The control of fluid to the cylinder 32 will now be described in connection with FIGS. 4-6. The hydraulic actuator 32 is controlled or piloted by a magnetic latching valve 66 that is secured to the edge of upper base 16 via lug 68 (FIG. 1) or other suitable means. The latching valve 66 operates in concert with a pair of permanent magnets 70, 72 (both visible in FIG. 1; only magnet 70 visible in FIG. 4) attached to the stationary, lower base 18. The permanent magnets are reversed in polarity, so that, for example, magnet 70 has its North pole facing toward the latching valve, while magnet 72 is reversed, with its South pole facing the latching valve. As will be described further below, the position of the magnets 70, 72 on the rim 74 of the lower base 18 may be adjusted to obtain the desired arc of motion of the sprinkler head.

The magnets 70, 72 are identical, so only one need be described in detail. Thus, the magnet 70, for example, is housed in a split case 76 that is provided with a female rail 78 along a radially-inner edge thereof, adapted to mate with and slide along a male rail 80 extending about the periphery of the fixed lower base 18. A finger screw 82 extends through the lower magnet case portion 84 and into an interior hub 86 of the upper case portion 88. This arrangement allows the magnet 70 to be clamped to the base 18 (or male rail 80) at any desired position about the periphery of the base 18. This same arrangement applies to the second magnet 72, so that a defined arc between about 5 and 355 degrees between the two magnets can be located and set anywhere about the lower base 18.

In the exemplary but nonlimiting embodiment described herein, the latching valve 66 (see FIG. 4) may be a Gem-Sol latching solenoid 3-way valve (Model No. GEM-A-21133E0-000), modified by removal of the solenoid coil. With reference to FIG. 4, the latching valve 66 incorporates a magnet 90 that is movable in opposite directions along a center post or rod 92. For purposes of this description, it is assumed that the South pole of the magnet 90 faces downwardly, towards the magnets 70, 72. In general terms, when the magnet 90 aligns with the magnet 70, the magnets 70, 90 attract, pulling the magnet 90 downwardly within the latching valve 66, and when the magnet 90 aligns with magnet 72, the magnets are repulsed, moving the magnet 90 upwardly within the latching valve 66. The magnets 70 (and by extension, magnet 72) and 90 are each shown in FIG. 4 to include a stack of individual magnets. It will be appreciated however, that either a single magnet or a stack of magnets may be used in each case. The advantage of using a stack of individual magnets lies in the ability to more easily adjust the strength of the magnetic force and thus the stroke of the latching valve, but, of course, a single magnet having the desired magnetic strength would be equally suitable.

Figure 5:
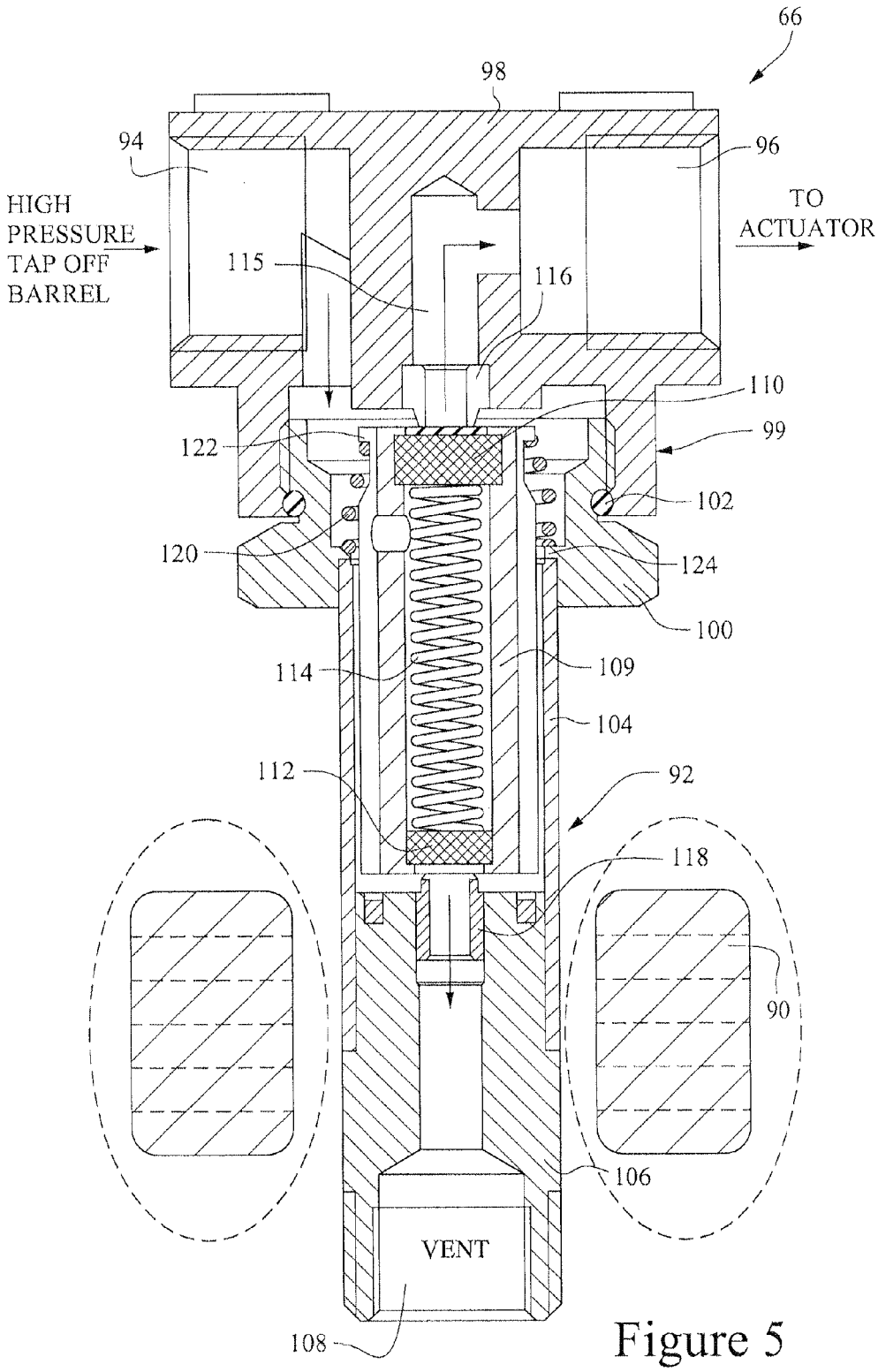
FIG. 5 is a simplified section of the magnetic latching valve shown in FIG. 4, with the valve shown in an upward-seated position, as determined by the magnetic interaction of the latching valve and magnet located on the stationary base.
Figure 6:
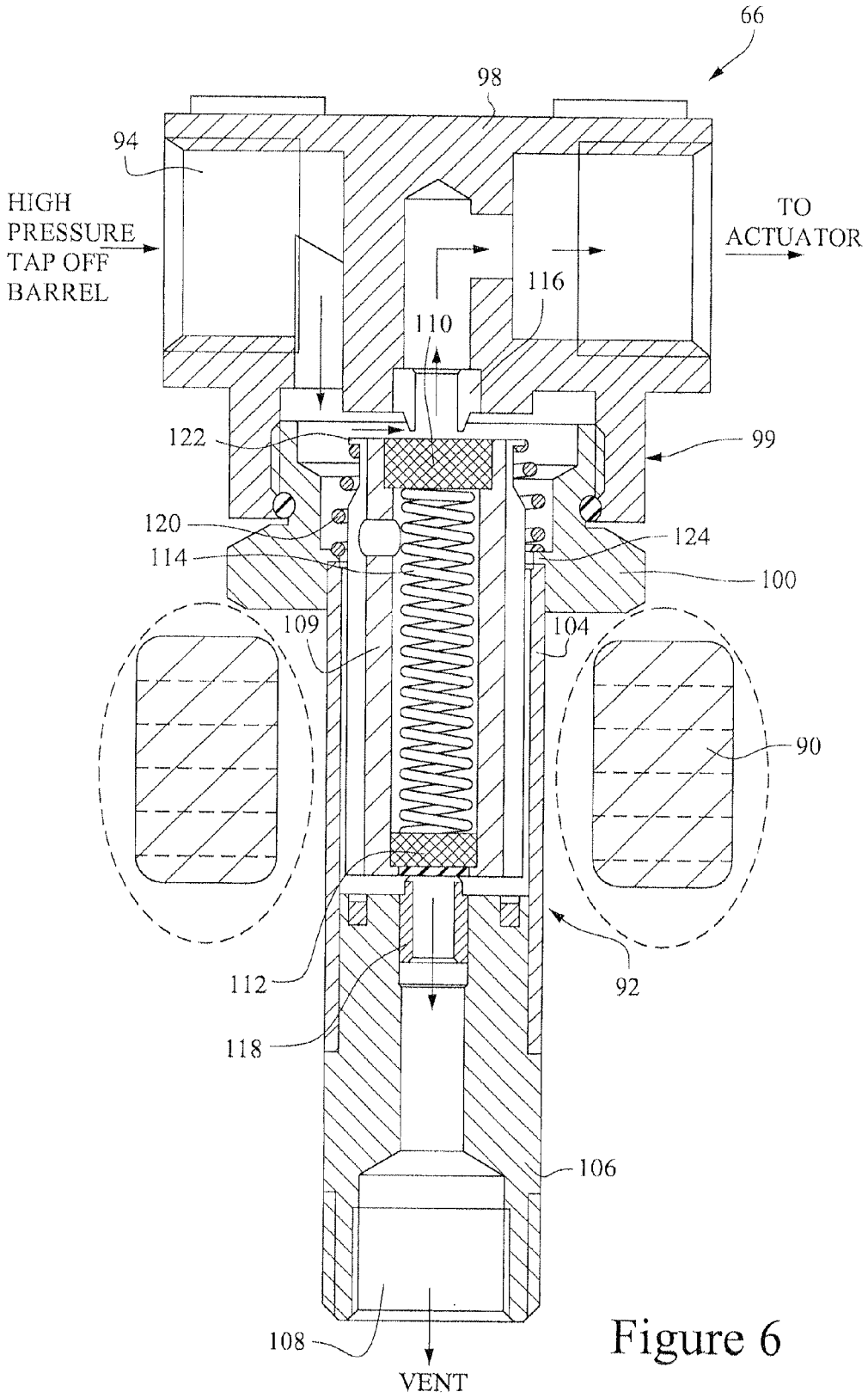
FIG. 6 is a view similar to FIG. 5, but showing the latching valve in a lower-seated position as determined by the interaction of the latching valve with another magnet on the stationary base.

FIGS. 5 and 6 are simplified partial sections of the latching valve 66 (with the outer housing removed) that illustrate in more detail the operation of the latching valve, utilizing a single magnet 90 (the optional stack is indicated by broken lines) that is movable axially in two opposite directions along the center post or rod 92. The valve is formed to include an inlet port 94, an outlet port 96 in a housing portion 98 (see also FIG. 1) that is connected to a relatively short first sleeve 99 that is threaded or otherwise secured to a bushing 100 within the latching valve 66, with an O-ring seal 102 sealing the interface. A relative long second sleeve 104 of reduced diameter extends from the bushing 100 to a vent plug 106 formed with a vent port 108. Thus, the center post or rod 92 is made up of the second sleeve 104 and the vent plug 106. A hollow piston 109 is centered within the latching valve with valves 110, 112 at opposite ends thereof, and a coil spring 114 extending between the valves. A side port 115 of the housing portion 98 is fitted or formed with a first internal valve seat 116 facing the valve 110, while the upper end of the vent plug 106 is fitted or formed with a second internal valve seat 118 facing the valve 112. The coil spring 114 dampens the movement of the piston and respective valves as they alternately engage their respective valve seats.

The hollow piston 109 is biased upwardly toward the valve seat 116 by a tapered coil spring 120 extending between a radial flange 122 at the upper end of the piston 109 and a shoulder 124 formed in the bushing 100. Note that the bushing 100, vent plug 106 and piston 109 are made of a ferritic stainless steel (magnetic) material and thus influenced by the position of the surrounding magnet 90. The second sleeve 104 is preferably an Austenitic stainless steel (nonmagnetic) material. As shown in FIG. 5, when the sprinkler has rotated to reaction angle Ø, the attraction between magnets 70 and 90 causes the magnet 90 to move downwardly to the position shown in FIG. 5. By relocating the flux lines of the magnetic circuit downwardly (see the broken-line oval-shaped force field), the spring 120 is now able to drive the piston 109 upwardly, so that valve 110 engages the valve seat 116, shutting off flow through the side port 115 and outlet 96 to the diaphragm actuator 32, and opening the vent port 108 as valve 112 moves off the seat 118. With flow shut off to the actuator 32, the actuator spring 60 will move the actuator cylinder 32 to the position shown in FIG. 3, causing the barrel portions 12, 14 and the upper base 16 to rotate in a clockwise direction to the reaction angle Ø. This, in turn, will cause the barrel portions 12, 14 and upper base 16 to rotate via the emitted stream, in a counterclockwise direction, moving the latching valve 66 away from the magnet 70 toward the magnet 72.

As the latching valve 66 aligns with the magnet 72, the repulsion force between magnet 72 and magnet 90 will cause the magnet 90 to move upwardly to the position shown in FIG. 6. This movement also moves the magnetic flux lines upwardly, such that the valve 112 will be drawn into engagement with the valve seat 118 to complete the magnetic circuit, closing the vent port 108. At the same time, the valve 110 moves off the valve seat 116, opening the flow path from the high pressure inlet port 94 (connected via line 126 to the barrel portion 12 providing the source of high pressure water to the latching valve via tap 127) through the outlet port 96 to the diaphragm actuator 32 where the actuator cylinder will reverse direction (see FIG. 1) causing the barrel to swing back to reaction angle Ø'. Now the barrel portions 12, 14 and base 18 will rotate in the opposite direction, with this alternating direction of rotation occurring continuously until the water supply is shut off.

It will be appreciated that other mechanisms may be utilized to pilot the actuator 32. For example, a three-way mechanical toggle valve mounted on the base 16 could be utilized in combination with adjustable stops mounted on the male rail 80. The manner in which the toggle valve would interact with the adjustable stops to operate the actuator as described above is well within the knowledge of one skilled in the art.

Figure 7:
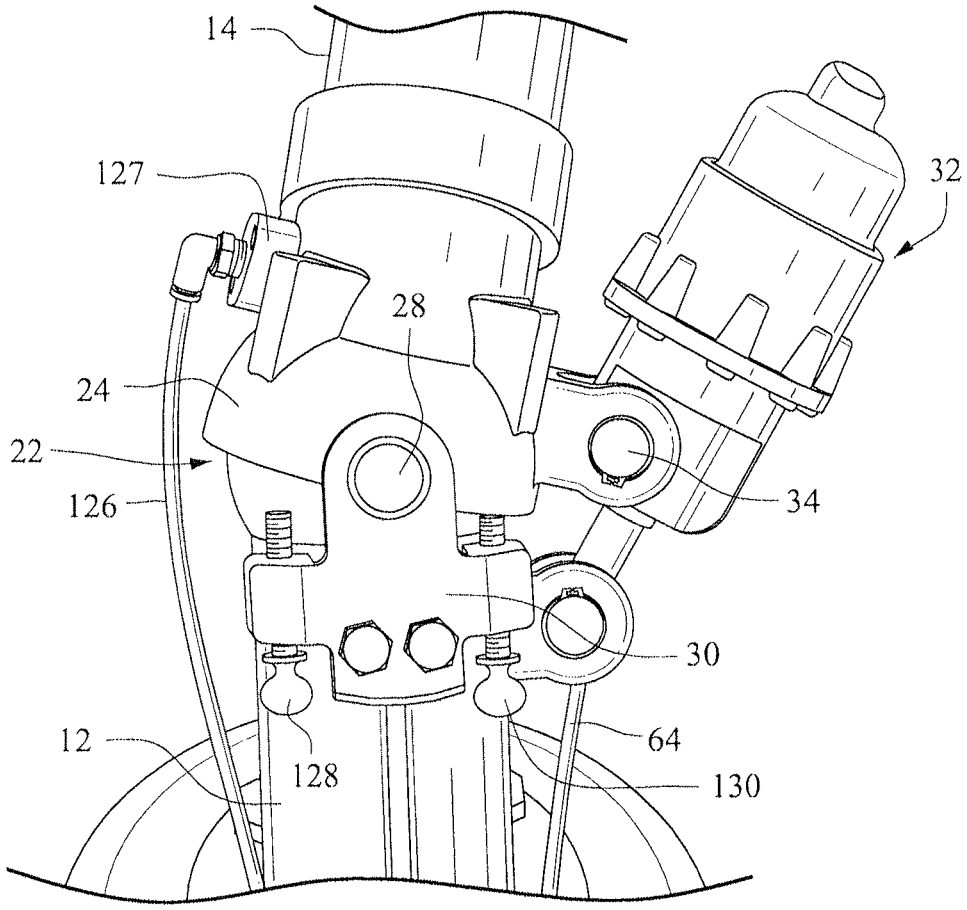
FIG. 7 is an enlarged partial perspective view illustrating an adjustment mechanism for the limits of movement of the upper-movable barrel portion.

With reference now to FIG. 7, it will be appreciated that the barrel reaction angle may be adjusted by means of thumb screws 128, 130 threaded into one of the brackets 30 and engageable with the lower edge of inverted cup-shaped portion 24 of the ball joint 22.

Figure 8:
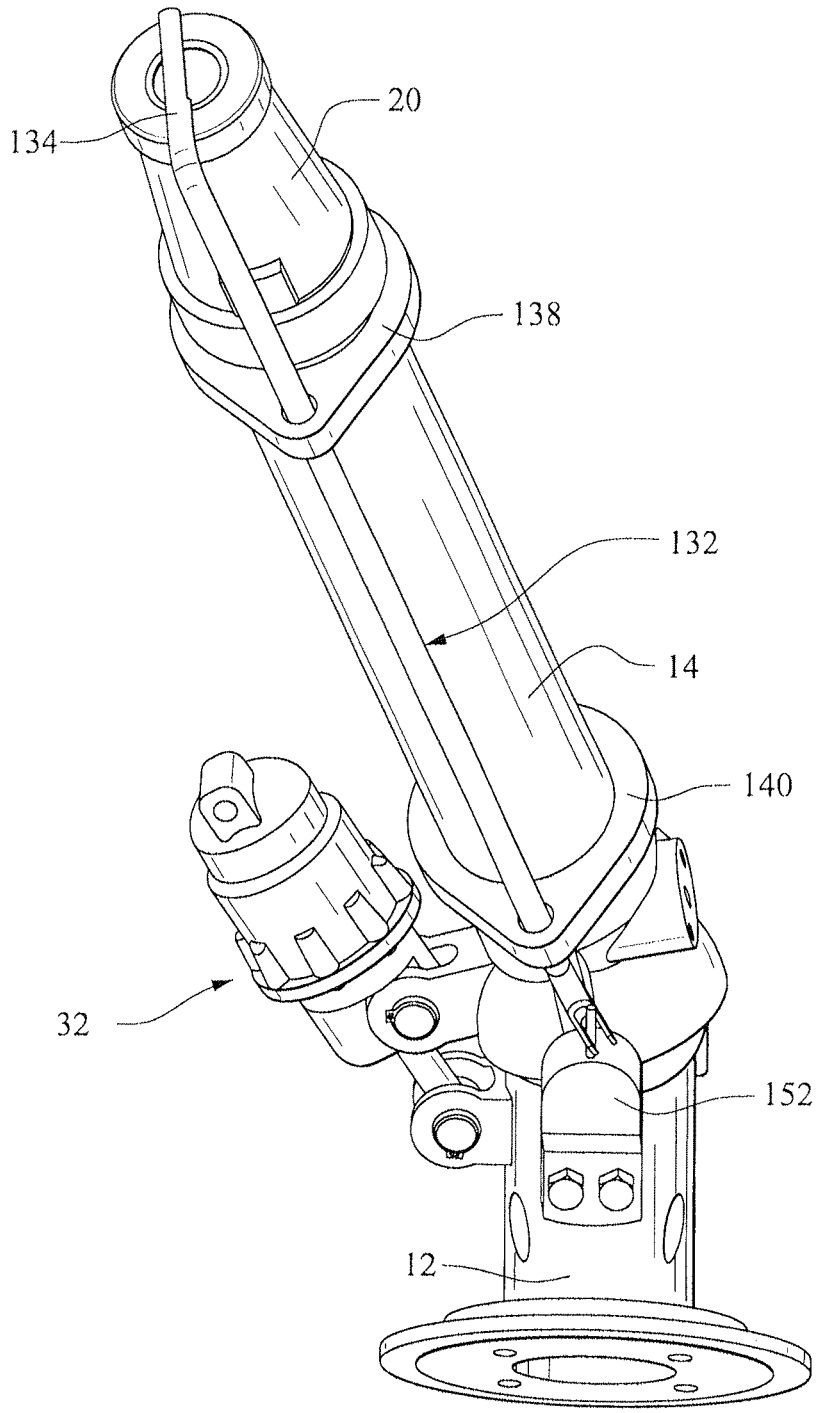
FIG. 8 is a perspective view of the high-volume sprinkler head showing a stream interrupter rod in a first position.
Figure 9:
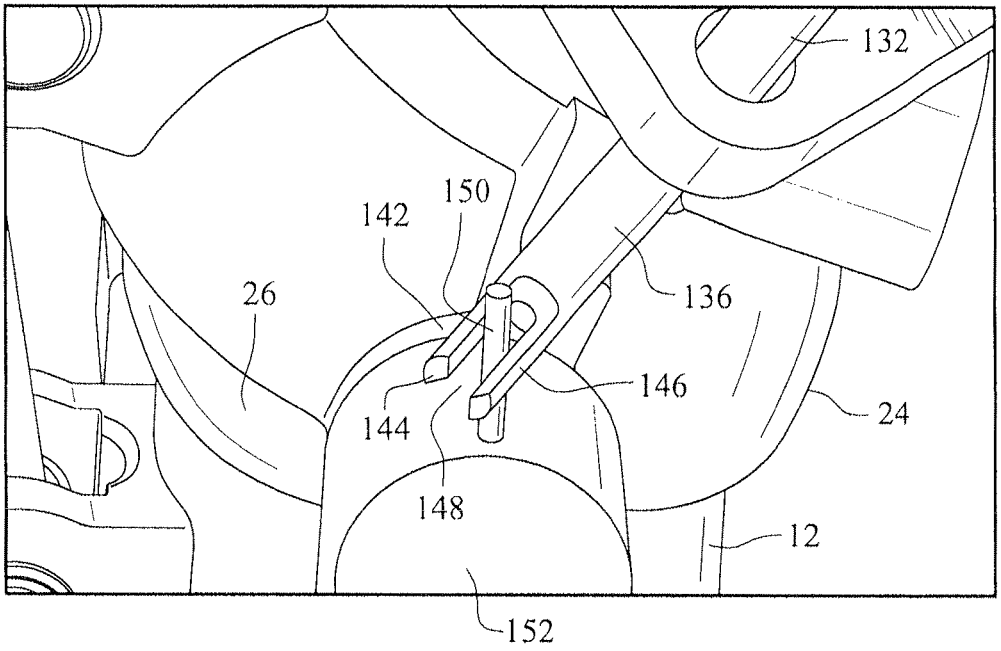
FIG. 9 is a partial perspective view of the base portion of the stream interrupter rod shown in FIG. 8, illustrating the interaction of the stream interrupter rod with a fixed post on the fixed barrel portion of the sprinkler head.
Figure 10:
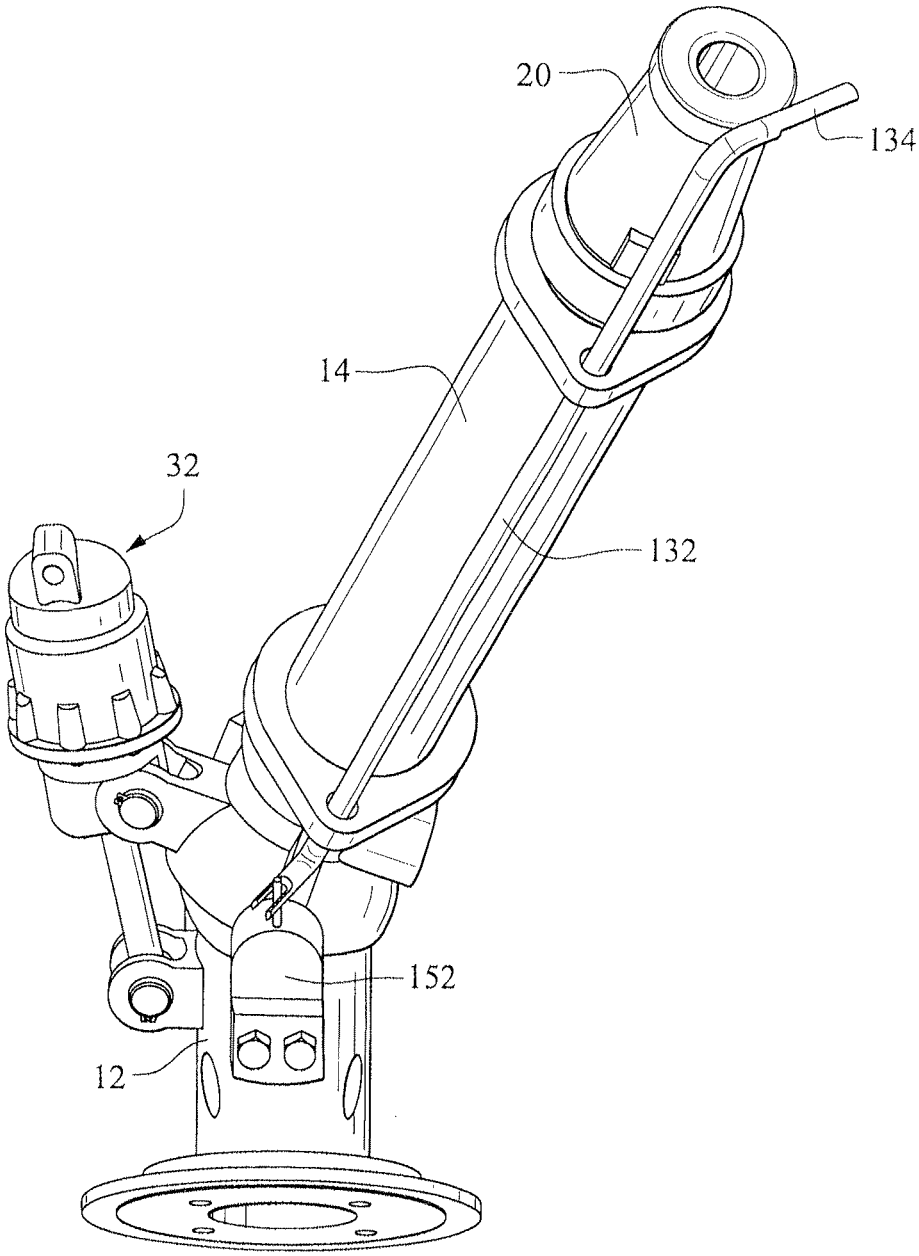
FIG. 10 is a perspective view of the high-volume sprinkler head showing the stream interrupter rod in a second position.

Another feature of the exemplary embodiment relates to the incorporation of a stream interrupter, best seen in FIGS. 8-10.

More specifically, an elongated stream interrupter rod 132 is formed with a distal end 134 bent at a substantially 90-degree angle relative to the rod 132, and a proximate end 136, also bent at a substantially right-angle. The stream interrupter rod 132 is supported on the barrel portion 14 by means of spaced rings 138, 140 provided with apertures through which the rod 132 passes. As best seen in FIG. 9, the proximate end of the rod 132 is formed to include a slotted-free end 142 (or fork) comprised of legs 144, 146, separated by a slot 148. A peg or post 150 extends upwardly from a bracket 152 (secured to the fixed barrel portion 12), received within the slot 148. It will be appreciated that as the barrel portion 14 pivots relative to the fixed barrel portion 12, the post or peg 150 will cause the rod 132 to rotate from the position shown in FIG. 8 to the position shown in FIG. 10 and vice versa. Thus, as shown in FIG. 8, the distal end 134 is oriented directly in the path of the stream emitted from the nozzle 20, causing the stream to break up and disperse in a wider pattern when the actuator cylinder 32 is in the position shown in FIGS. 1 and 8.

Upon pivoting motion of the barrel 14 relative to the barrel portion 12 to the position shown in FIGS. 2 and 10 upon relative extension of the cylinder 32 vis-à-vis the piston rod 38, the stream interrupter will be pivoted out of the emitted stream path as shown in FIG. 10 so that the emitted stream remains concentrated and is thrown a maximum distance. Thus, the back and forth movement of the stream interrupter rod 132 will fill in the irrigation distribution pattern. The stream interrupter rod 132 is also arranged so that it is in the position shown in FIG. 8 upon start up to avoid formation of a trench caused by the powerfully-emitted stream before the sprinkler begins to rotate, which may otherwise occur without initial interruption of the stream.

FIGS. 11-14 illustrate a modified stream interrupter rod mounted on a high-volume sprinkler head as shown in FIGS. 1-10. For convenience, for components of the modified stream interrupter, similar reference numerals are used but with the prefix "2" added. Thus, with initial reference to FIG. 11, the elongated stream interrupter rod 232 is formed with a distal end 234 which is shaped in the form of a hook which lies substantially in a plane parallel to the plane of the nozzle surface 21.

At the proximate end of the rod 232, there is a proximate-end piece 242 extending substantially perpendicular to the rod 232. Unlike the embodiment shown in FIGS. 8-10, the proximate-end piece 242 is separately formed and attached to the rod 232. The end piece 242 is otherwise similar in that it terminates at a fork formed by spaced legs 244, 246 separated by a slot 248 which receives the post 250 extending from the bracket 252.

The post 250 is removably-secured to the bracket 252 to facilitate the replacement if needed.

Figure 11:
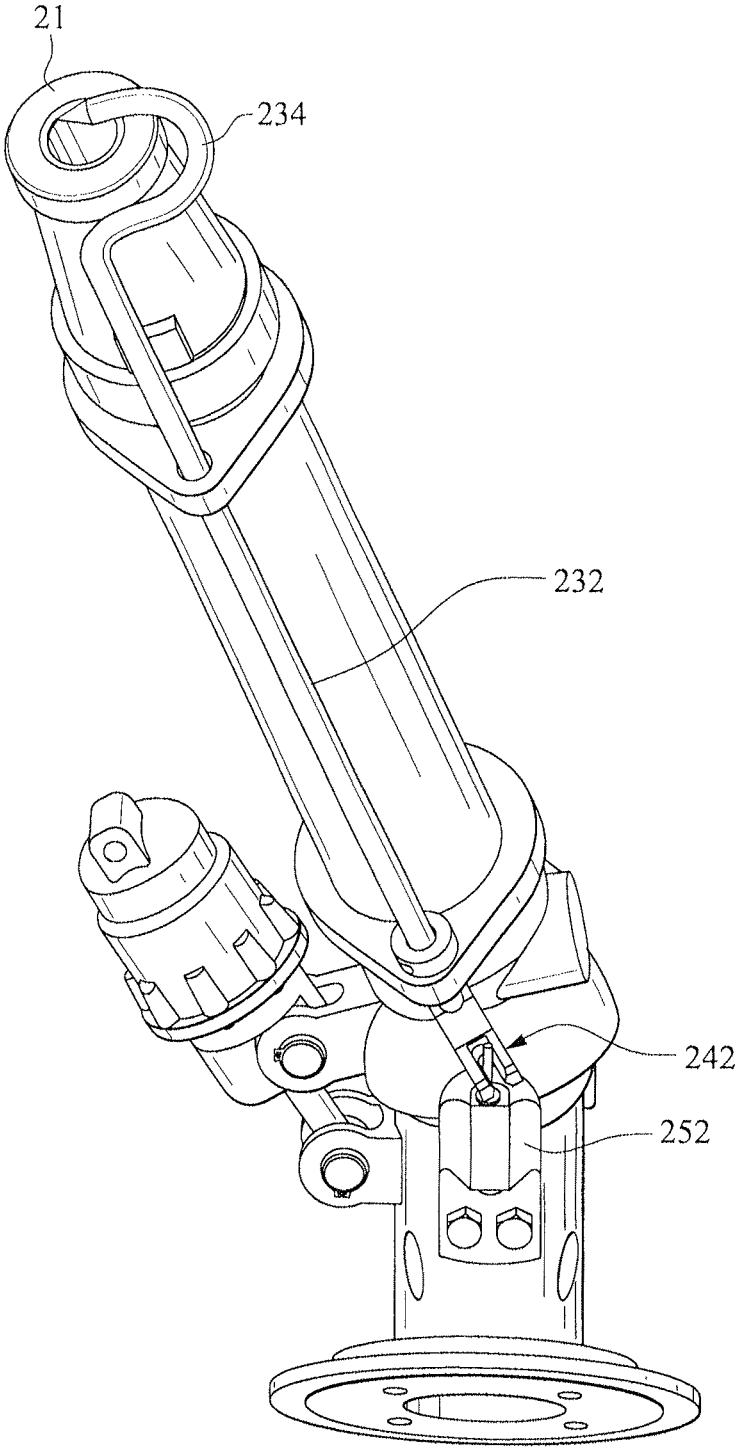
FIG. 11 is a perspective view of the high-volume sprinkler head showing a modified stream interrupter rod in a first position.
Figure 12:
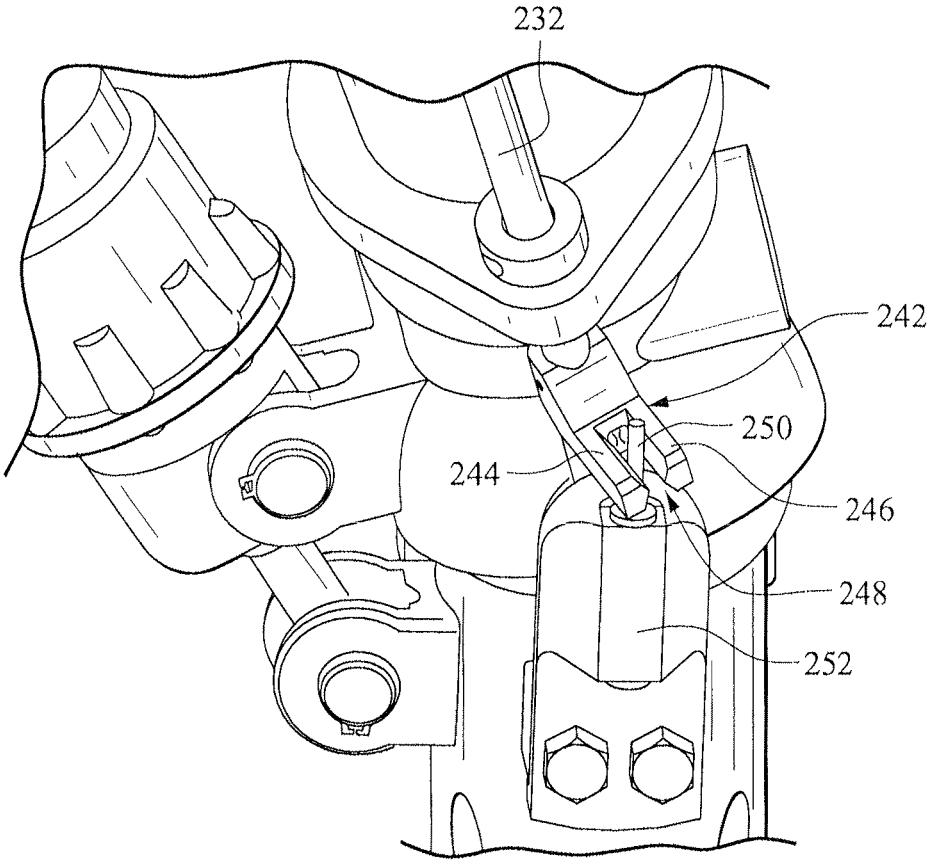
FIG. 12 is an enlarged detail of the proximate end of the stream interrupter rod shown FIG. 11.

In FIGS. 11 and 12, the interrupter rod 232 is shown in a first position where the hook-shaped distal end 234 interrupts the stream emitted from the nozzle 20 when the actuator cylinder 32 is in the position shown in FIGS. 1, 8 and 11.

Figure 13:
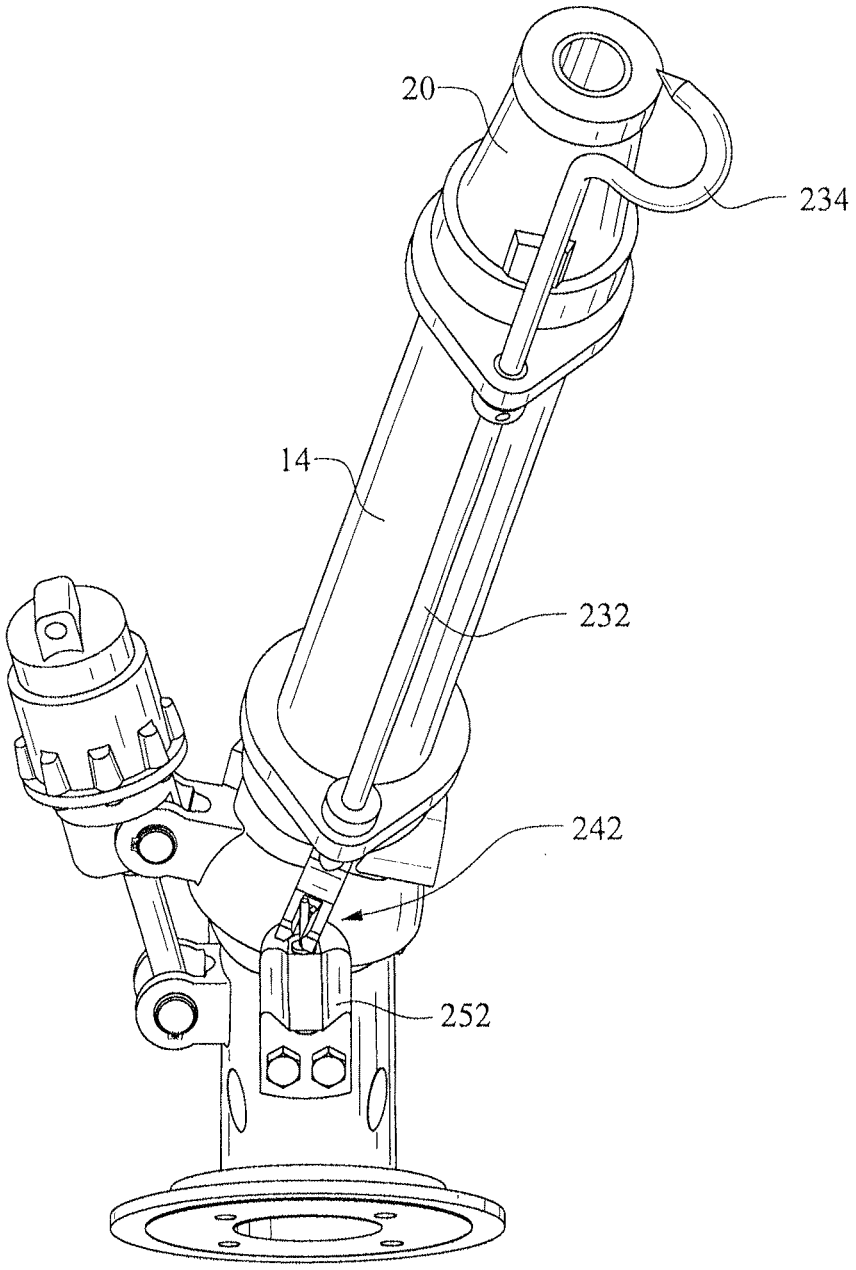
FIG. 13 is a perspective view of the high-volume sprinkler head showing the stream interrupter rod of FIGS. 11 and 12 in a second position.
Figure 14:
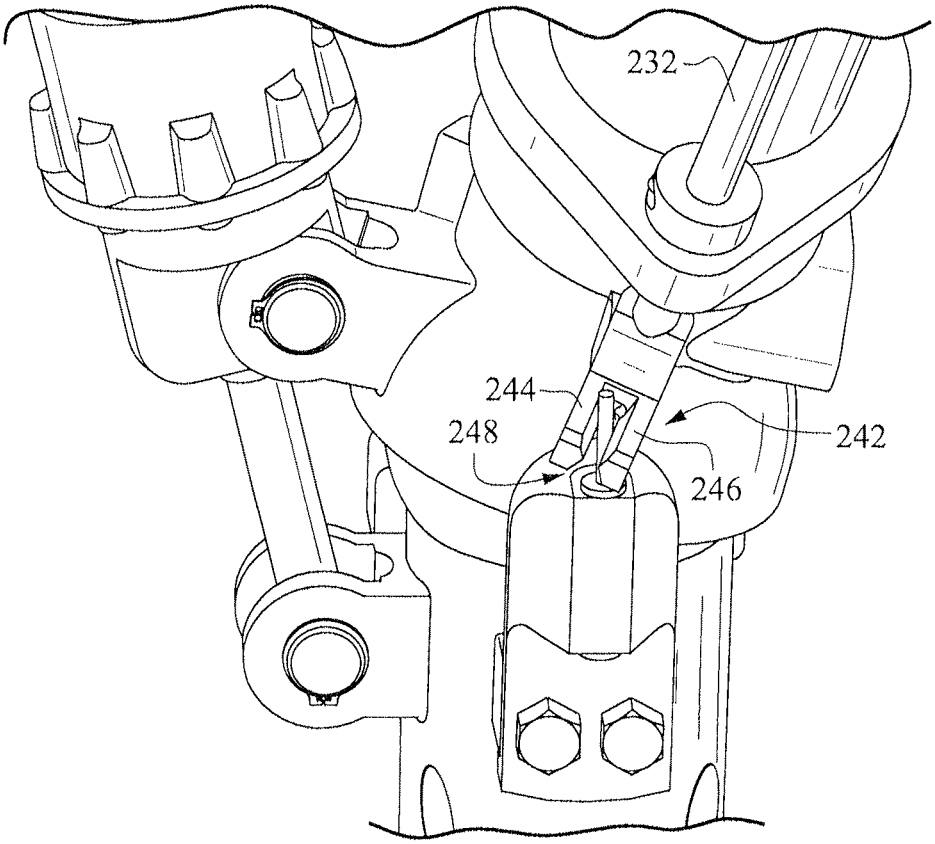
FIG. 14 is an enlarged detail of the proximate end of the stream interrupter rod shown in FIG. 13.

In reference now to FIGS. 13 and 14, the actuator cylinder 32 has extended relative to the piston rod 38, pivoting the upper-movable barrel portion 14 to the position shown in FIGS. 2, 10 and 13, thereby causing the proximate-end piece 242 to rotate about the post 250, and the hook-shaped distal end 234 to pivot away from the nozzle orifice. It will be appreciated that the interrupter rod 232 may have other shapes at the distal end 234 and that the proximate end configurations of the rod 232 may also vary, so long as the distal end of the interrupter rod is movable into and out of the emitted stream as a function of movement of the barrel portion 14 between its adjusted drive reaction angles.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A high-volume sprinkler head comprising:

a barrel having a nozzle at one end thereof, said barrel having a fixed portion and a relatively movable portion adapted for pivoting movement relative to said fixed portion, said barrel mounted on an annular upper support base rotatably supported on a lower stationary base for rotation in opposite directions through an arc about a substantially vertical axis;

an actuator arranged to pivot said relatively movable portion of said barrel relative to said fixed portion of said barrel between predetermined first and second reaction angles that cause said barrel and said annular upper support base to rotate in opposite directions, about said substantially vertical axis, respectively, when a stream is emitted from said nozzle;

first and second magnets supported at circumferentially-spaced locations about an edge of said lower stationary base, said pair of magnets having opposite polarities; and a magnetic valve mounted on said upper support base in fluid communication with said actuator, said magnetic valve adapted to cause fluid to propel said actuator to move said movable barrel portion to said predetermined first reaction angle when said magnetic valve is proximate to said first magnet, and further adapted to cause fluid to propel said actuator to move said movable barrel portion to said predetermined second reaction angle when said magnetic valve is proximate to said second magnet.

2. The high-volume sprinkler head of claim 1 wherein said first and second magnets are adjustable along said edge of said lower stationary base to thereby enable adjustment of said arc.

3. The high-volume sprinkler head of claim 1 wherein said fluid under pressure supplied from said magnetic valve to said actuator is sourced from fluid passing through said barrel.

4. The high-volume sprinkler head of claim 1 wherein said actuator comprises a cylinder pivotably mounted on said relatively movable portion and a piston rod having a distal end pivotably mounted to said fixed portion of said barrel, such that, when fluid is supplied to said actuator, said cylinder is extended relative to said piston rod to thereby move said relatively moveable portion of said barrel to said first predetermined reaction angle.

5. The high-volume sprinkler head of claim 4 wherein, when fluid is drained from said fluid-operated actuator, a spring causes said cylinder to retract to thereby move said relatively moveable portion of said barrel to said second predetermined reaction angle.

6. The high-volume sprinkler head of claim 1 wherein said fixed portion and said relatively movable portion of said barrel are connected by a ball joint, an upper component of the ball joint provided on said relatively movable portion of said barrel and a lower component of said ball joint provided on said relatively fixed portion of said barrel; and wherein a pair of oppositely extending pivot pins are provided on said upper component of said ball joint, said pivot pins received in respective brackets secured to said fixed portion of said barrel.

7. The high-volume sprinkler head of claim 6 wherein adjustment screws on said brackets are arranged to engage said upper component to enable adjustment of said pivoting movement of said fixed portion relative to said relatively movable portion, and thereby enable adjustment of said first and second reaction angles.

8. The high-volume sprinkler head of claim 2 wherein said first and second magnets each have separable sections secured by a screw, enabling clamping of said first and second magnets at different locations about said edge of said lower stationary base.

9. The high-volume sprinkler head of claim 1 further comprising a stream interrupter rod having a distal end movable into and out of the stream emitted from said nozzle.

10. The high-volume sprinkler head of claim 9 wherein said distal end of said stream interrupter rod is secured to said nozzle for rotation about a longitudinal axis of said stream interrupter rod; and a proximate end of said stream interrupter rod is secured to said relatively fixed portion of said barrel.

11. The high-volume sprinkler head of claim 10 wherein said distal end of said stream interrupter rod is bent at a substantially ninety degree angle; said proximate end bent at a substantially ninety-degree angle and terminates at a fork engageable by a post extending from a bracket mounted on said relatively fixed portion of said barrel.

12. A high-volume sprinkler head comprising:

a barrel having a nozzle at one end thereof, said barrel having a fixed portion and a relatively movable portion adapted for adjustably limited pivoting movement relative to said fixed portion, said barrel mounted on an annular upper support base rotatably supported on a lower stationary base for rotation in opposite directions through an arc about a substantially vertical axis;

a fluid-operated actuator arranged to pivot said relatively movable portion of said barrel relative to said fixed portion of said barrel between predetermined first and second reaction angles that cause said barrel and said annular upper support base to rotate in opposite directions through an arc about a substantially vertical axis, respectively, when a stream is emitted from said nozzle;

first and second magnets adjustably supported at circumferentially-spaced locations about an edge of said lower stationary base, thereby enabling adjustment of said arc;

a magnetic valve mounted on said upper support base in fluid communication with said actuator, said magnetic valve adapted to align with one of said magnets upon rotation of said barrel and said annular upper support base in one of said opposite directions and to align with the other of said pair of magnets upon rotation of said barrel and said annular upper support base in the other of said opposite directions, about said substantially vertical axis, respectively, to supply fluid under pressure to said fluid-operated actuator to cause said relatively movable portion of said barrel to pivot to said first predetermined reaction angle, and to drain fluid from said fluid-operated actuator to cause said relatively movable portion of said barrel to pivot to said second predetermined reaction angle; and further comprising a stream interrupter rod having a distal end movable into and out of the stream emitted from said nozzle.

13. The high-volume sprinkler head of claim 12 wherein said fluid under pressure supplied from said magnetic valve to said fluid-operated actuator is sourced from fluid passing through said barrel.

14. The high-volume sprinkler head of claim 12 wherein fluid drained from said fluid-operated actuator exits a vent port in said magnetic valve.

15. The high-volume sprinkler head of claim 12 wherein said fluid-operated actuator comprises a cylinder pivotably mounted on said relatively movable portion and a piston rod having a distal end pivotably mounted to said fixed portion of said barrel, such that, when fluid is supplied to said actuator, said cylinder is extended relative to said piston rod to thereby move and said relatively moveable portion of said barrel to said first predetermined reaction angle.

16. The high-volume sprinkler head of claim 12 wherein said fixed portion and said relatively movable portion of said barrel are connected by a ball joint, an upper component of the ball joint provided on said relatively movable portion of said barrel and a lower component of said ball joint provided on said relatively fixed portion of said barrel; and wherein a pair of oppositely extending pivot pins are provided on said upper component of said ball joint, said pivot pins received in respective brackets secured to said fixed portion of said barrel.

17. The high-volume sprinkler head of claim 16 wherein adjustment screws on said brackets are arranged to engage said upper component to enable adjustment of said pivoting movement of said fixed portion relative to said relatively movable portion, and thereby enable adjustment of said first and second reaction angles.

18. The high-volume sprinkler head of claim 12 wherein said distal end of said stream interrupter rod is secured to said nozzle for rotation about a longitudinal axis of said stream interrupter rod; and a proximate end of said stream interrupter rod is secured to said relatively fixed portion of said barrel.

19. The high-volume sprinkler head of claim 18 wherein said distal end of said stream interrupter rod is bent at a substantially ninety degree angle; said proximate end bent at a substantially ninety-degree angle and terminates at a fork engageable by a post extending from a bracket mounted on said relatively fixed portion of said barrel.

20. A high-volume sprinkler head comprising:

a barrel having a nozzle at one end thereof, said barrel having a fixed portion and a relatively movable portion adapted for pivoting movement relative to said fixed portion, said barrel mounted on an annular upper support base rotatably supported on a lower stationary base for rotation in opposite directions through an arc about a substantially vertical axis;

an actuator arranged to pivot said relatively movable portion of said barrel relative to said fixed portion of said barrel between predetermined first and second reaction angles that cause said barrel and said annular upper support base to rotate in opposite directions, about said substantially vertical axis, respectively, when a stream is emitted from said nozzle;

first and second stops supported at circumferentially-spaced locations about an edge of said lower stationary base; and a valve mounted on said annular upper support base in fluid communication with said actuator, said valve adapted to cause fluid to propel said actuator to move said movable barrel portion to said predetermined first reaction angle when said valve is proximate to said first stop, and further adapted to cause fluid to propel said actuator to move said movable barrel portion to said predetermined second reaction angle when said valve is proximate to said second stop, wherein said valve is a magnetic valve and said first and second stops comprise first and second magnets.

* * * * *